US011927408B2

(12) United States Patent
Bender

(10) Patent No.: US 11,927,408 B2
(45) Date of Patent: Mar. 12, 2024

(54) FIRE CONTROL ASSEMBLY

(71) Applicant: In Ovation LLC, Vadnais Heights, MN (US)

(72) Inventor: Terrence Dwight Bender, Minneapolis, MN (US)

(73) Assignee: In Ovation LLC

( * ) Notice: Subject to any disclaimer, the term of this patent is extended or adjusted under 35 U.S.C. 154(b) by 33 days.

(21) Appl. No.: 17/155,003

(22) Filed: Jan. 21, 2021

(65) Prior Publication Data

US 2021/0239417 A1 Aug. 5, 2021

Related U.S. Application Data

(63) Continuation-in-part of application No. 17/153,787, filed on Jan. 20, 2021, now Pat. No. 11,592,255.

(60) Provisional application No. 62/964,079, filed on Jan. 21, 2020, provisional application No. 62/963,526, filed on Jan. 20, 2020.

(51) Int. Cl.

| | |
|---|---|
| ***F41A 19/10*** | (2006.01) |
| ***F41A 19/12*** | (2006.01) |
| ***F41A 19/14*** | (2006.01) |

(52) U.S. Cl.

CPC ..... *F41A 19/10* (2013.01); *F41A 19/12* (2013.01); *F41A 19/14* (2013.01)

(58) Field of Classification Search

CPC ..... F41A 19/10; F41A 19/12; F41A 19/14; F41A 17/74

USPC ..... 42/69.01–69.3

See application file for complete search history.

(56) References Cited

U.S. PATENT DOCUMENTS

| | | | | |
|---|---|---|---|---|
| 109,513 | A * | 11/1870 | Hay | F41A 17/74 42/66 |
| 2,457,296 | A | 12/1948 | Yawman | |
| 2,920,413 | A | 1/1960 | Marhefka et al. | |
| 3,206,884 | A | 9/1965 | Purvis | |
| 3,768,190 | A | 10/1973 | Ruger et al. | |
| 4,004,496 | A | 1/1977 | Snodgrass et al. | |
| 4,005,540 | A | 2/1977 | Robinson | |
| 4,310,981 | A | 1/1982 | Waddell | |
| 4,433,610 | A | 2/1984 | Tatro | |
| 4,667,429 | A | 5/1987 | Perazzi | |
| 4,680,884 | A | 7/1987 | Smith, Jr. et al. | |
| 4,691,461 | A | 9/1987 | Behlert | |
| 4,955,155 | A | 9/1990 | Jones | |
| 5,018,292 | A | 5/1991 | West | |

(Continued)

FOREIGN PATENT DOCUMENTS

DE 102007004588 7/2008

*Primary Examiner* — Joshua E Freeman
*Assistant Examiner* — Benjamin S Gomberg
(74) *Attorney, Agent, or Firm* — Laabs Intellectual Property

(57) ABSTRACT

In some embodiments, a fire control assembly comprises a trigger rotatable about a trigger axis and a hammer rotatable about a hammer axis. A trigger spring is arranged to bias the trigger in a first direction about the trigger axis. A hammer spring is arranged to bias the hammer in a second direction about the hammer axis. The trigger comprises a trigger sear and a stop. The hammer comprises a hammer sear and a catch. The fire control assembly comprises a first orientation wherein the trigger sear contacts the hammer sear and impedes rotation of the hammer, and a second orientation wherein the stop contacts the catch and impedes rotation of the hammer.

16 Claims, 10 Drawing Sheets

(56) References Cited

U.S. PATENT DOCUMENTS

| | | | | |
|---|---|---|---|---|
| 5,463,829 | A | 11/1995 | Sprangers | |
| 5,503,137 | A | 4/1996 | Fusco | |
| 5,548,914 | A | 8/1996 | Anderson | |
| 5,623,114 | A | 4/1997 | Soper | |
| 5,822,903 | A | 10/1998 | Davis, Sr. | |
| 5,881,485 | A | 3/1999 | Milazzo | |
| 5,904,132 | A | 5/1999 | Biller | |
| 6,164,001 | A | 12/2000 | Lee | |
| 6,298,594 | B1 | 10/2001 | Strayer | |
| 6,367,465 | B1 | 4/2002 | Buccieri, Jr. | |
| 6,615,527 | B1 | 9/2003 | Martin | |
| 6,651,642 | B1 | 11/2003 | Powers | |
| 6,722,072 | B1 | 4/2004 | Mccormick | |
| 6,772,072 | B2 | 8/2004 | Ganguli et al. | |
| 7,162,824 | B1 | 1/2007 | Mccormick | |
| 7,188,561 | B1 | 3/2007 | Kelbly | |
| 7,293,385 | B2 | 11/2007 | Mccormick | |
| 7,331,136 | B2 | 2/2008 | Geissele et al. | |
| 7,600,338 | B2 | 10/2009 | Geissele | |
| 7,661,220 | B2 | 2/2010 | Crandall et al. | |
| 7,854,084 | B1 | 12/2010 | Rutherford | |
| 7,992,338 | B2 | 8/2011 | Bowman et al. | |
| 8,893,607 | B2 | 11/2014 | Audibert et al. | |
| 9,046,313 | B1 * | 6/2015 | Lutton | F41A 19/15 |
| 9,175,917 | B2 * | 11/2015 | Bender | F41A 19/10 |
| 9,618,289 | B1 * | 4/2017 | Geissele | F41A 19/46 |
| 9,927,197 | B1 * | 3/2018 | Geissele | F41A 19/45 |
| 10,006,733 | B2 * | 6/2018 | Bender | F41A 19/16 |
| 2003/0228915 | A1 | 12/2003 | Goko | |
| 2005/0229911 | A1 | 10/2005 | Simo et al. | |
| 2006/0101695 | A1 * | 5/2006 | Longueira | F41A 9/45 42/69.02 |
| 2006/0207149 | A1 | 9/2006 | Lazor | |
| 2008/0010889 | A1 | 1/2008 | Metzger et al. | |
| 2009/0183414 | A1 | 7/2009 | Geissele | |
| 2009/0266348 | A1 | 10/2009 | Yeh | |
| 2010/0281739 | A1 | 11/2010 | Geissele | |
| 2011/0167691 | A1 | 7/2011 | Bowman et al. | |
| 2011/0167697 | A1 | 7/2011 | Geissele | |
| 2012/0117841 | A1 | 5/2012 | Joubert et al. | |
| 2013/0047484 | A1 | 2/2013 | Wickser, Jr. | |
| 2013/0118050 | A1 | 5/2013 | Alicea | |
| 2013/0167423 | A1 | 7/2013 | Lupher et al. | |
| 2013/0213376 | A1 | 8/2013 | Kenworthy | |
| 2013/0269233 | A1 | 10/2013 | Chin | |
| 2014/0366418 | A1 | 12/2014 | Stakes | |
| 2016/0018176 | A1 | 1/2016 | Fellows et al. | |
| 2018/0045481 | A1 * | 2/2018 | Williams | F41A 19/42 |

* cited by examiner

FIRE CONTROL ASSEMBLY

CROSS-REFERENCE TO RELATED APPLICATIONS

This application claims the benefit and is a Continuation-in-Part of U.S. patent application Ser. No. 17/153,787, filed Jan. 20, 2021, which claims the benefit of U.S. Patent Application No. 62/963,526, filed Jan. 20, 2020, and claims the benefit of U.S. Patent Application No. 62/964,079, filed Jan. 21, 2020, the entire content of each of which are hereby incorporated herein by reference.

BACKGROUND OF THE INVENTION

This invention relates to a fire control mechanism for a firearm. Firearms may be subject to a drop test, wherein the firearm is cocked and dropped, causing it to impact a supporting surface. If the fire control system operates during the impact and fires a round, the firearm fails the drop test.

There remains a need for fire control assemblies capable of passing a drop test while providing other benefits over a stock trigger.

It is also desirable for a fire control mechanism to feel smooth while the trigger is pulled. Triggers that do not feel smooth are often described as having a gritty pull. As fire control systems improve, there remains a need for novel fire control designs that have improved feel and force characteristics.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fire control assembly comprises a trigger rotatable about a trigger axis and a hammer rotatable about a hammer axis. A trigger spring is arranged to bias the trigger in a first direction about the trigger axis. A hammer spring is arranged to bias the hammer in a second direction about the hammer axis. The trigger comprises a trigger sear and a stop. The hammer comprises a hammer sear and a catch. The fire control assembly comprises a first orientation wherein the trigger sear contacts the hammer sear and impedes rotation of the hammer, and a second orientation wherein the stop contacts the catch and impedes rotation of the hammer.

In some embodiments, the catch comprises a cavity and the stop comprises a protrusion.

In some embodiments, a sear engagement location and a catch engagement location are located to a common side of a reference plane that intersects the hammer axis and the trigger axis.

In some embodiments, in the first orientation, the hammer sear and the catch are located to a common side of a reference plane that intersects the hammer axis and the trigger axis.

In some embodiments, the hammer comprises a first width portion and a second width portion. The first width portion comprises the hammer sear and the second width portion comprises the catch. In some embodiments, the trigger comprises a first width portion and a second width portion. The first width portion comprises the trigger sear and the second width portion comprises the stop.

In some embodiments, the hammer comprises a first rotational position in the first orientation, a second rotational position in the second orientation and a third rotational position wherein the hammer is configured to strike a firing pin.

In some embodiments, the trigger sear contacts the hammer sear at a sear engagement location. A reference triangle extending between the trigger axis, the hammer axis and the sear engagement location comprises a sear location interior angle greater than 120 degrees.

In some embodiments, a fire control assembly comprises a trigger rotatable about a trigger axis and a hammer rotatable about a hammer axis. The trigger comprises a trigger sear. The hammer comprises a hammer sear. The trigger sear contacts the hammer sear at a sear engagement location. A reference triangle extending between the trigger axis, the hammer axis and the sear engagement location comprising a sear location interior angle greater than 130 degrees.

In some embodiments, a hammer sear radial distance is greater than a trigger sear radial distance. In some embodiments, a hammer sear radial distance is at least 1.5 times a trigger sear radial distance.

In some embodiments, a fire control assembly comprises a trigger rotatable about a trigger axis and a hammer rotatable about a hammer axis. The trigger comprises a trigger sear comprising a leading edge. The hammer comprises a hammer sear. A travel path of the leading edge does not overlap with hammer structure adjacent to the hammer sear.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
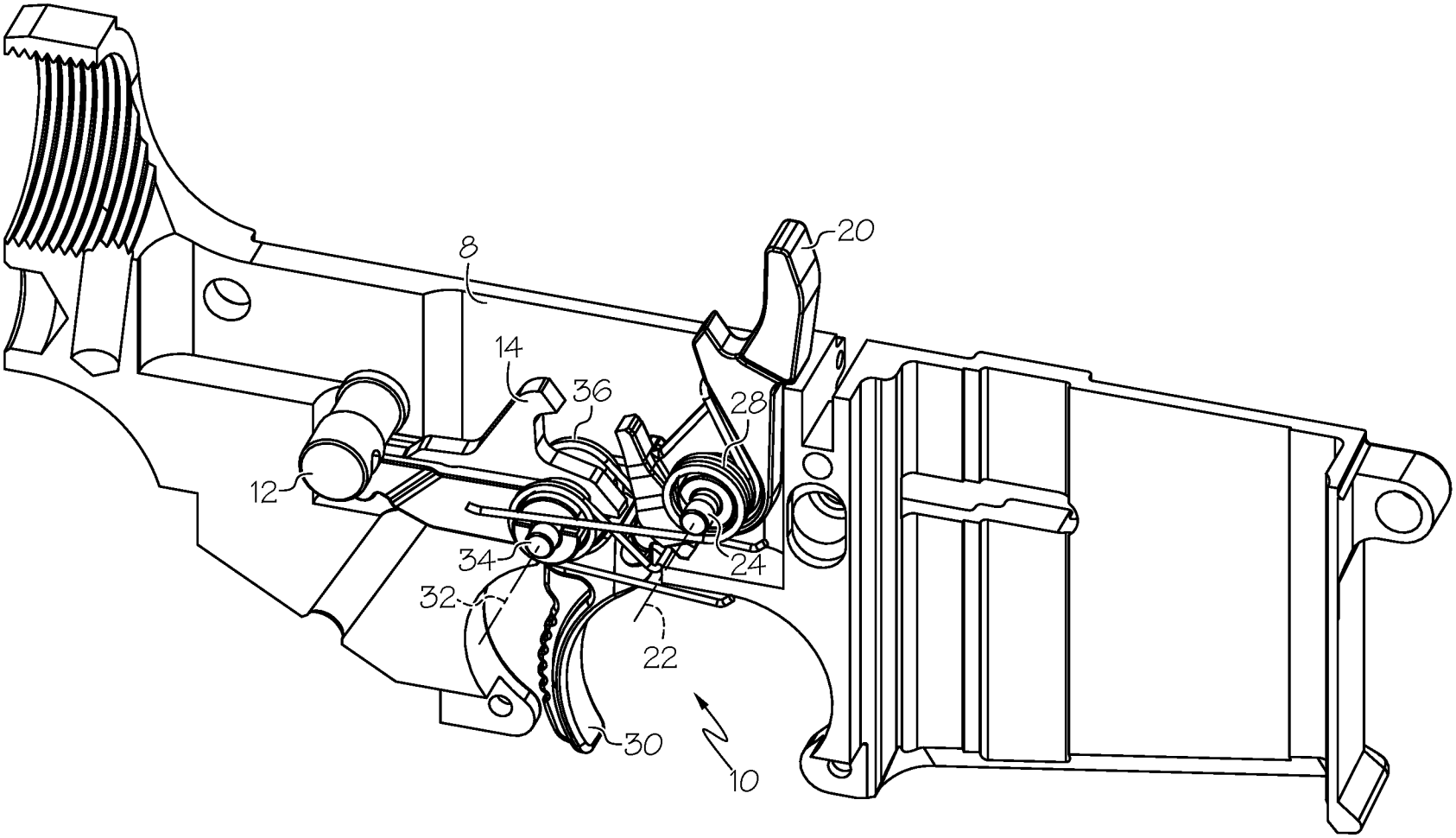
FIG. 1 shows an embodiment of a fire control assembly in a housing.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a fire control assembly 10 oriented in a housing 8. A fire control assembly 10 can be used in any suitable type of firearm. In some embodiments, a fire control assembly 10 is configured for use in an AR-style rifle, such as an AR15. In some embodiments, a housing 8 comprises an AR lower receiver. FIG. 1 shows the housing 8 partially cut away so parts of the fire control assembly 10 are more visible.

In some embodiments, the fire control assembly 10 comprises a hammer 20 arranged to pivot about a hammer axis 22 and a trigger 30 arranged to pivot about a trigger axis 32. In some embodiments, the hammer 20 is supported by a hammer pin 24 that is supported by the housing 8, and the trigger 30 is supported by a trigger pin 34 that is supported by the housing 8. In some embodiments, a hammer spring 28 is arranged to bias the hammer 20 in a predetermined rotational direction. In some embodiments, a trigger spring 36 is arranged to bias the trigger 30 in a predetermined rotational direction.

Figure 2:
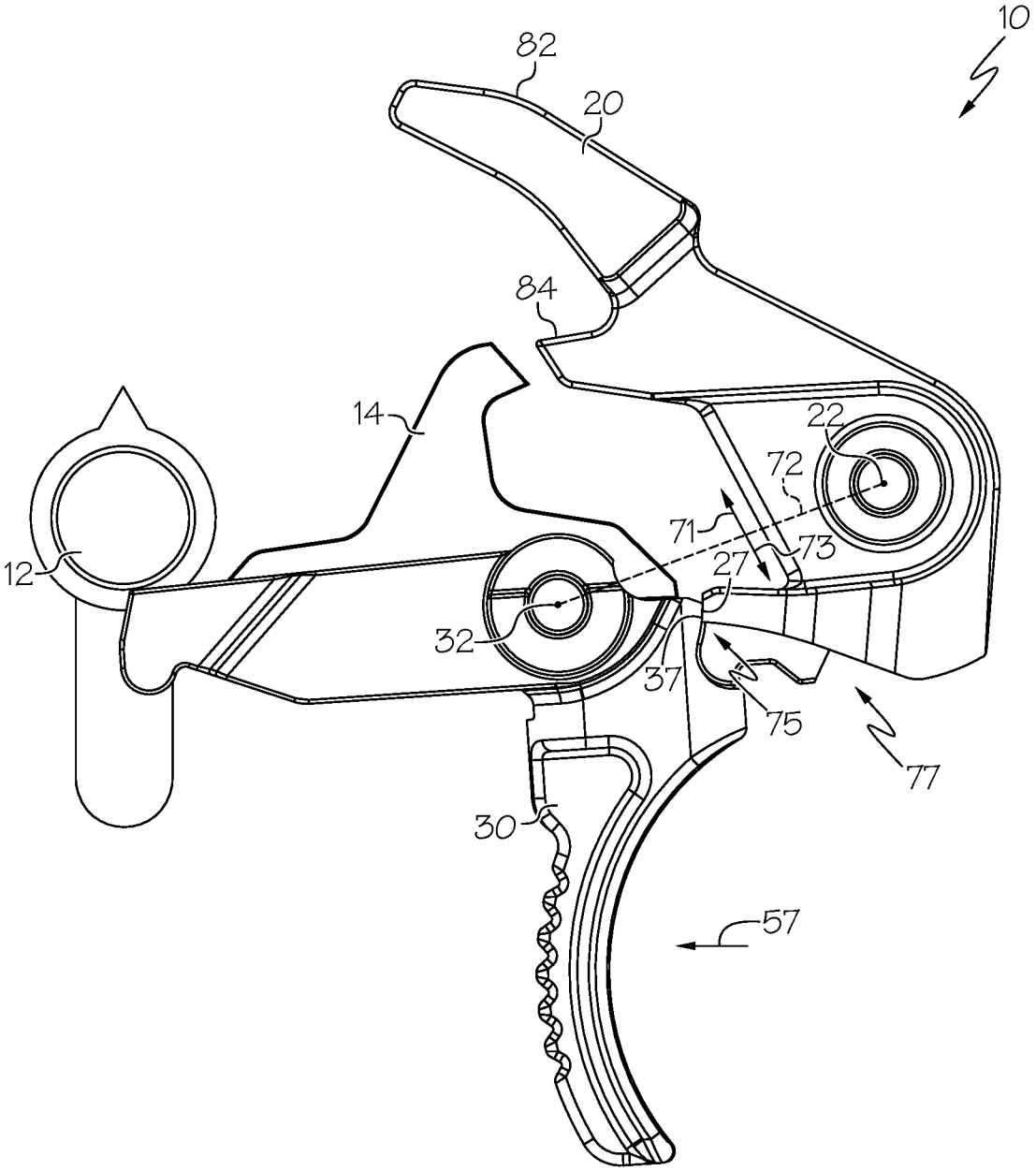
FIG. 2 shows an embodiment of a fire control assembly in a cocked orientation.

FIG. 2 shows portions of an embodiment of a fire control assembly 10 in a first orientation, which may be a ready-to-fire orientation. In some embodiments, the hammer 20 comprises a hammer sear 27 and the trigger comprises a trigger sear 37. The hammer sear 27 and trigger sear 37 are arranged to contact one another, and their engagement prevents the hammer 20 from being rotated (for example, under force from the hammer spring 28 shown in FIG. 1). As a user applies a force 56 to the trigger 30, the trigger 30 rotates about the trigger axis 32. When the trigger 30 rotates enough for the trigger sear 37 to clear the hammer sear 27, the hammer 20 will fall. In some embodiments, the trigger sear 37 is shaped as an arc about the trigger axis 32. In some embodiments, the hammer sear 27 is shaped as an arc about the trigger axis 32. In some embodiments, the trigger sear 37 comprises curvature and the hammer sear 27 comprises a similarly shaped curvature.

Figure 3:
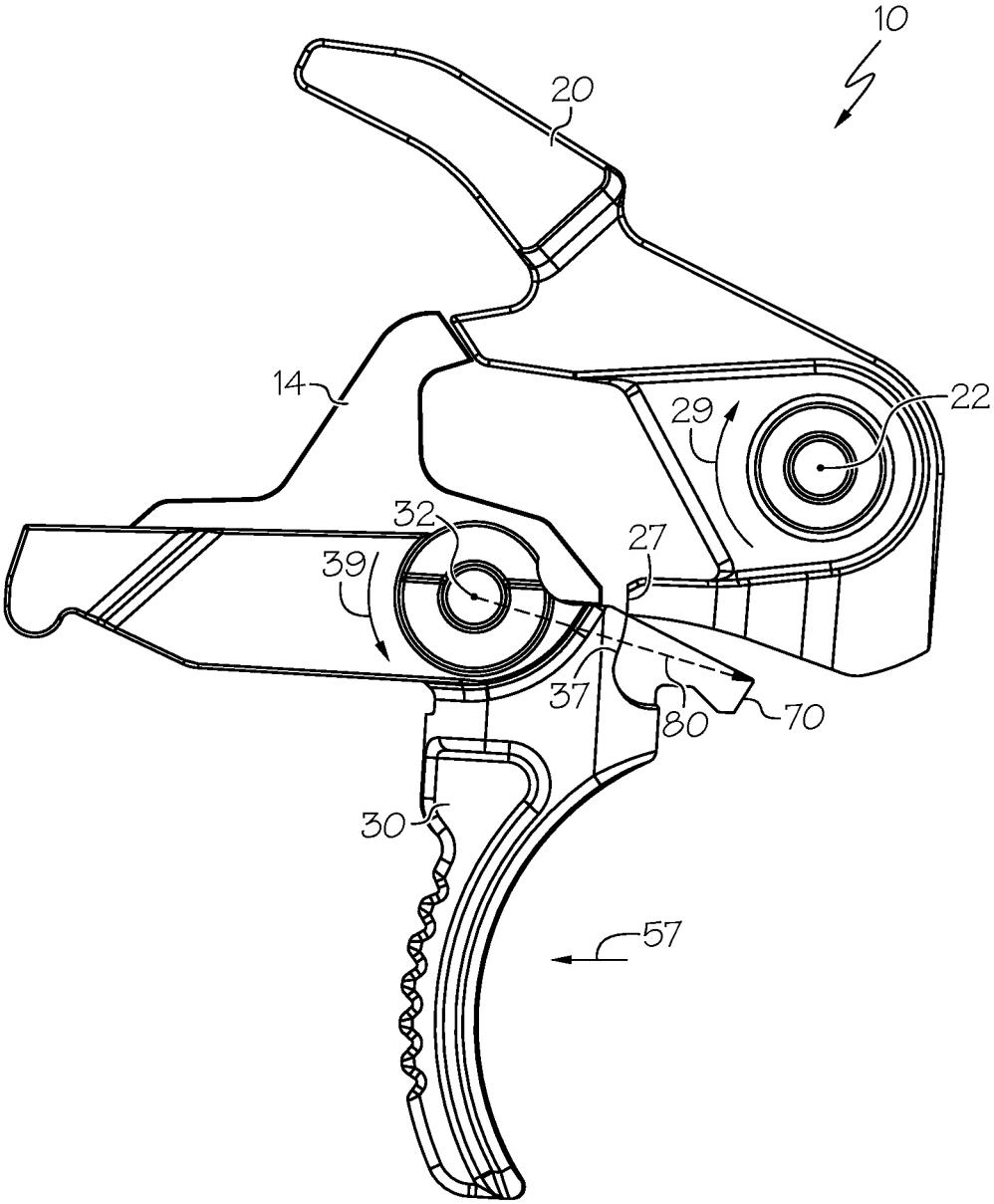
FIG. 3 shows the fire control assembly of FIG. 2 in another orientation.
Figure 4:
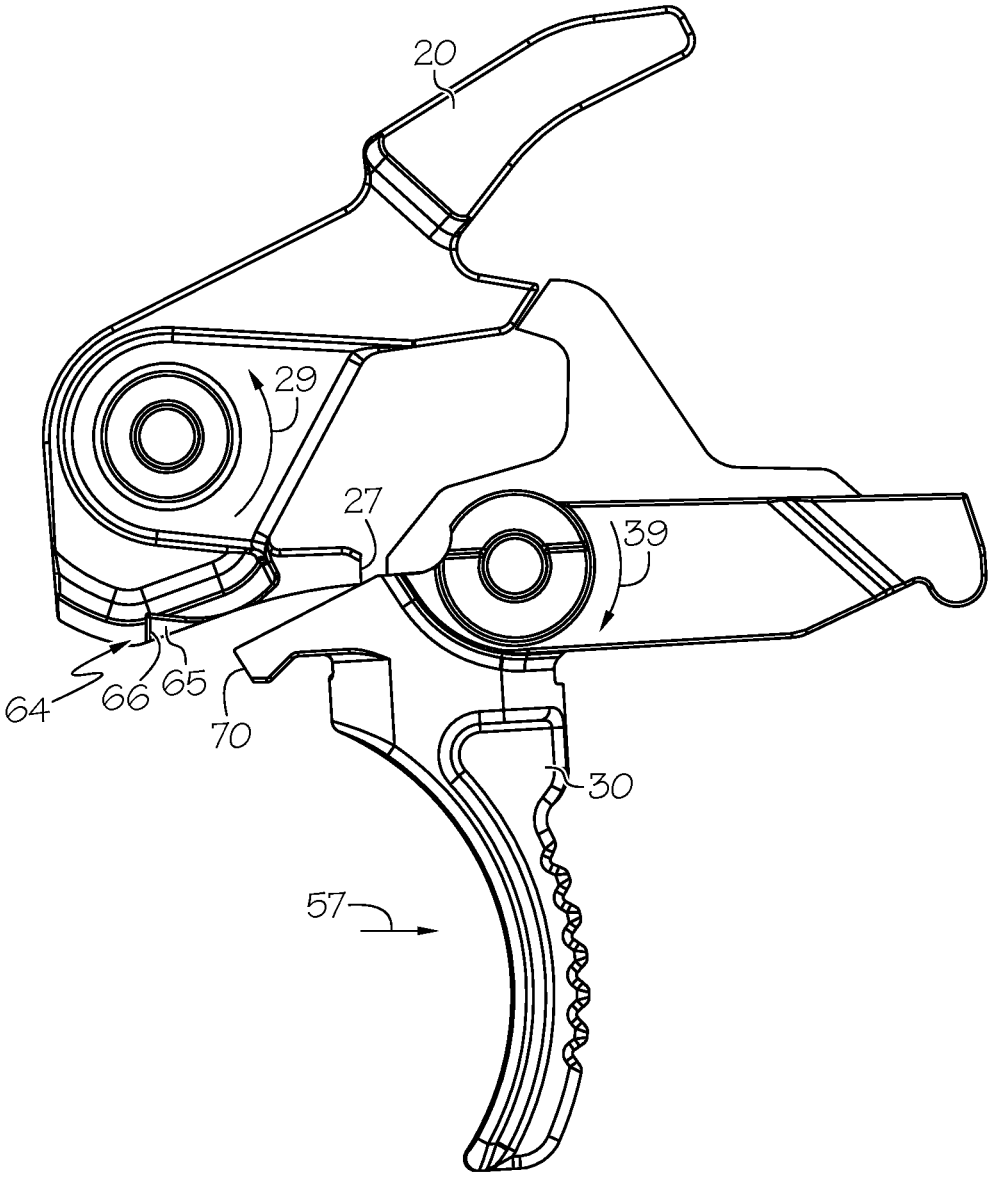
FIG. 4 shows the fire control assembly of FIG. 3 from the opposite side.
Figure 5:
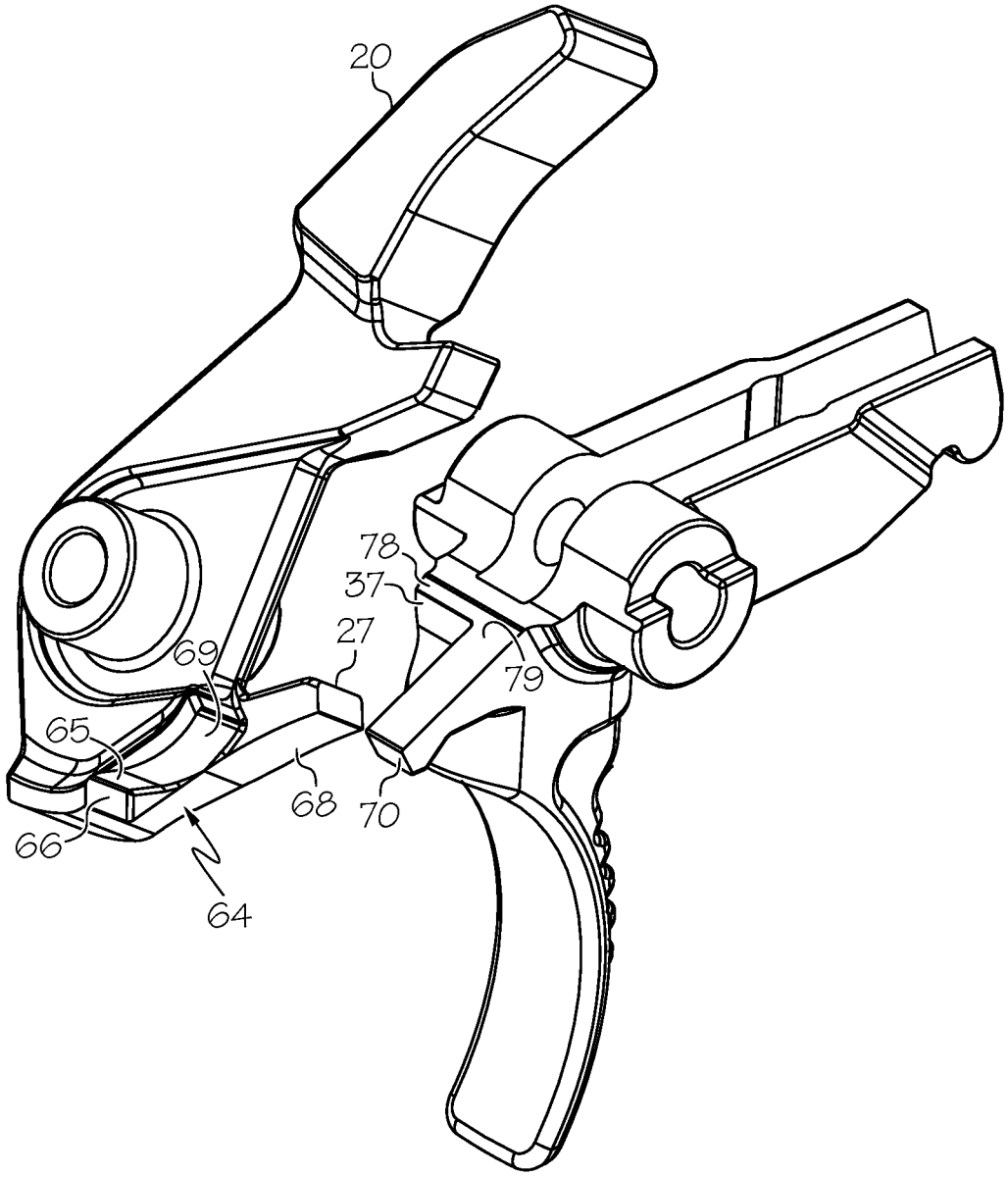
FIG. 5 shows an embodiment of a hammer and an embodiment of a trigger in another orientation.

FIGS. 3 and 4 show the hammer 20 and trigger 30 of FIG. 2 in another orientation, just as the trigger sear 37 is clearing the hammer sear 27. When the trigger sear 37 no longer interferes with movement of the hammer 20, the hammer spring force 29 acts to rotate the hammer 20. Under normal operation, the hammer 20 would impact a firing pin and cause a round to be fired.

Under certain conditions, for example during a drop test, it may be possible for the sears 27, 37 to disengage and allow the hammer 20 to fall even in the absence of any user applied force 56 operating the trigger 30.

Referring to FIGS. 4-8, in some embodiments, a hammer 20 comprises a catch 64 arranged to impede movement of the hammer 20 and prevent the hammer 20 from experiencing full operational travel or impacting a firing pin. In some embodiments, a catch 64 comprises a contacting surface 66. In some embodiments, the catch 64 comprises a cavity 65 formed in the hammer 20.

In some embodiments, the trigger 30 comprises a stop 70. In some embodiments, the stop 70 comprises a protrusion. In some embodiments, under certain conditions, the stop 70 is arranged to engage the catch 64 and stop rotational movement of the hammer 20. In some embodiments, the stop 70 contacts the contacting surface 66 of the catch 64.

In some embodiments, the hammer 20 comprises a first width portion 68 and a second width portion 69. In some embodiments, the first width portion 68 comprises the hammer sear 27. In some embodiments, the second width portion 69 comprises the catch 64.

In some embodiments, the trigger 30 comprises a first width portion 78 and a second width portion 79. In some embodiments, the first width portion 78 comprises the trigger sear 37. In some embodiments, the second width portion 79 comprises the stop 70.

Figure 6:
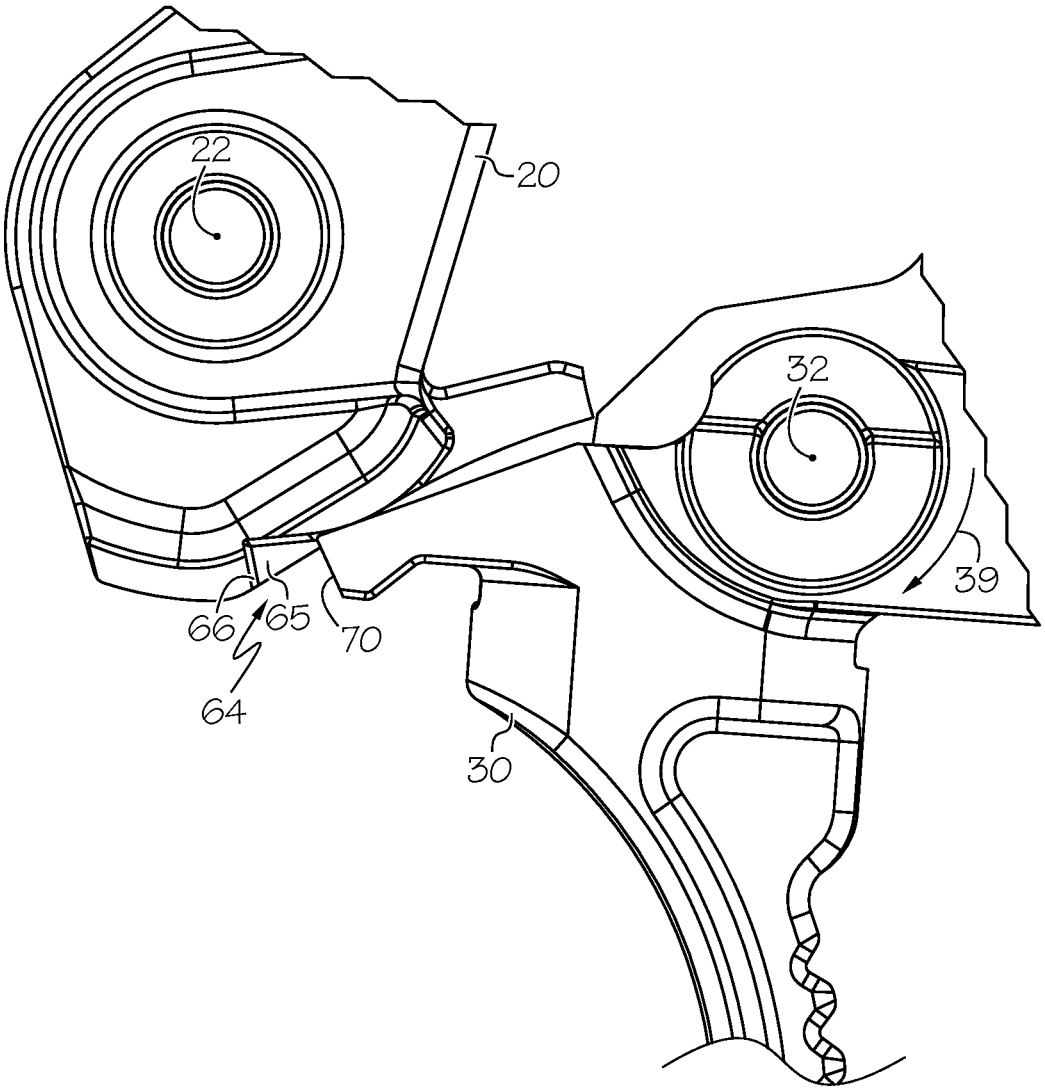
FIG. 6 shows an embodiment of a hammer and an embodiment of a trigger having a drop-safe feature.

FIG. 6 shows an orientation where the hammer 20 is falling and the trigger 30 is moving to arrest movement of the hammer 20. The trigger spring force 39 biases the trigger 30 to move, thereby moving the stop 70 into the cavity 65 of the catch 64.

Figure 7:
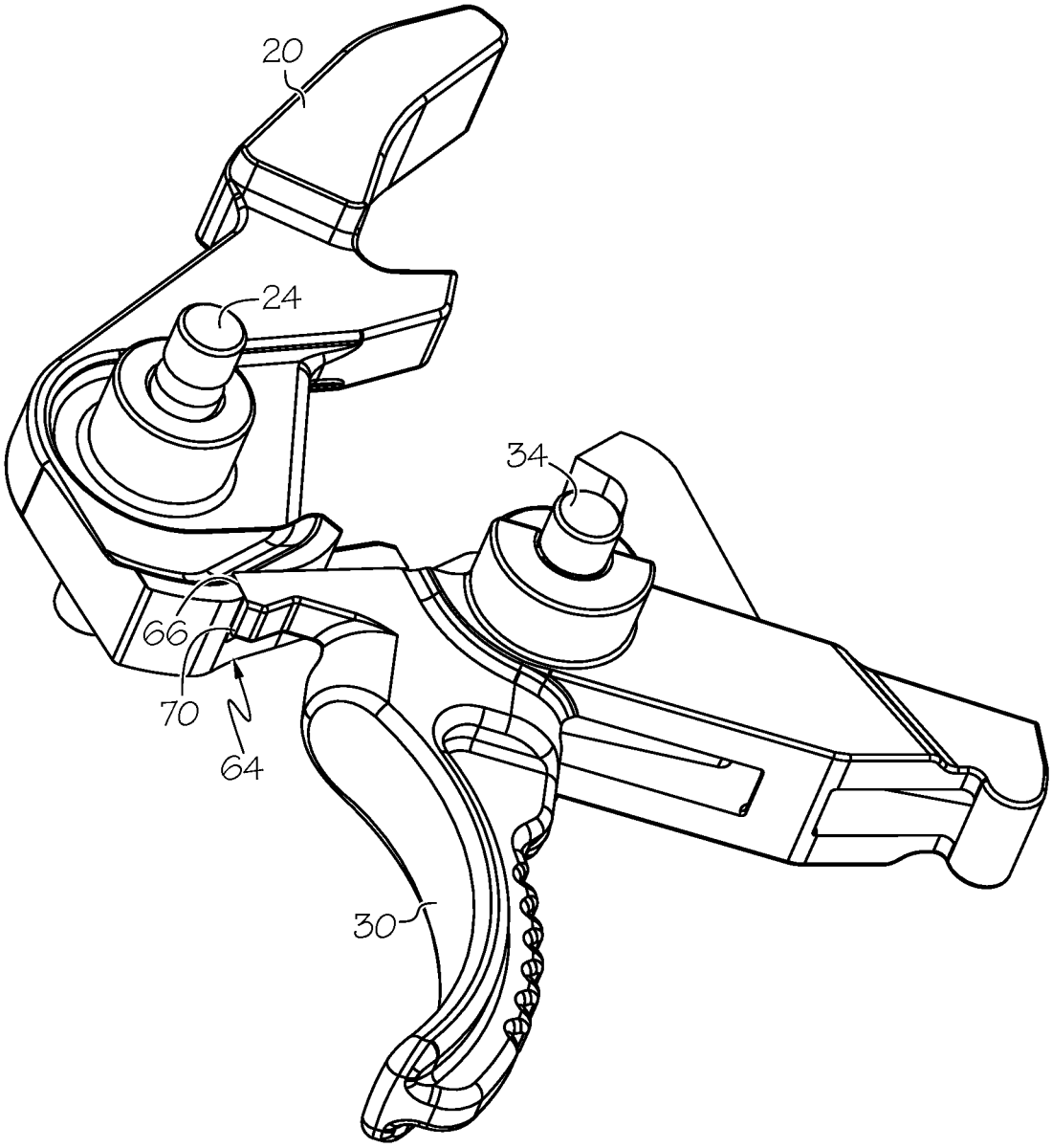
FIGS. 7 and 8 show an embodiment of a hammer and an embodiment of a trigger with a drop-safe feature engaged.
Figure 8:
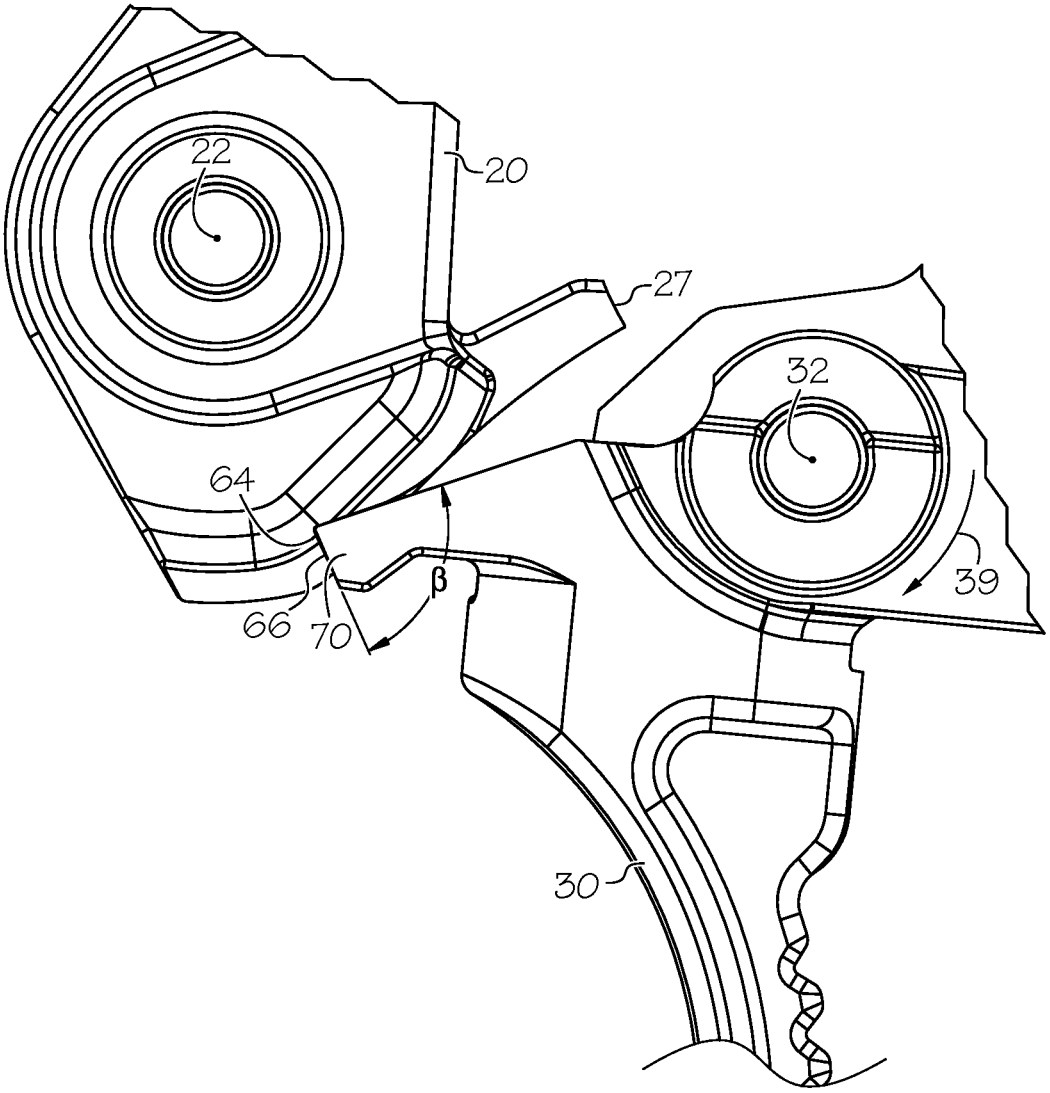

FIGS. 7 and 8 show the catch 64 engaged with the stop 70. Movement of the hammer 20 has been arrested. The stop 70 is positioned in the cavity 65 and arranged in contact with the contacting surface 66. Thus, the catch 64 has operated to stop the hammer 20. In some embodiments, when the catch 64 is engaged, disengagement of the catch 64 (e.g. by operation of the trigger 30 or alternatively by another condition, such as a drop/impact condition) will allow the hammer 20 to fall; however, in some embodiments, the hammer 20 will not fall with enough energy to fire a round even if it contacts the firing pin subsequent to disengagement of the catch 64.

In some embodiments, a distance between the trigger axis 32 and the trigger sear 37 is less than a distance between the trigger axis 32 and the stop 70.

In some embodiments, the catch 64 is configured to be released by operation of the trigger 30, for example by a user applied force 56. In some embodiments, disengagement of the catch 64 by operation of the trigger 30 requires a greater amount of user applied force 56 than disengagement of the sears 27, 37 by operation of the trigger 30. In some embodiments, the amount of force 56 required to disengage the catch 64 and stop 70 can be adjusted by adjusting the angle(s) of surfaces of the catch 64 and/or the stop 70. For example, in some embodiments, the contacting surface 66 of the catch 64 and a surface of the stop 70 can behave similar to a set of sears. In some embodiments, changing an orientation angle of the contacting surface 56 can change the force 56 required to disengage the catch 64. For example, in some embodiments, the contracting surface 66 is arranged parallel to a radial line extending from the hammer axis 22. In such embodiments, frictional engagement between the contacting surface 66 and the stop 70 may determine the force 56 required for disengagement, and the hammer 20 does not rotate as the stop 70 moves to clear the contacting surface 66. In some embodiments, the contacting surface 66, the stop 70, or both, are configured such that the hammer 20 is required to rotate as the stop 70 moves to clear the contacting surface 66. For example, when the contacting surface 66 is configured as shown in FIG. 6, oriented at a declining angle to a radial line extending from the hammer axis 22, the hammer 20 is required to rotate slightly in a direction opposite the hammer spring force 29 as the stop 70 moves to clear the contacting surface. A surface of the stop 70 can similarly be angled with respect to a tangent to a radial line extending from the trigger axis 32.

Referring to FIGS. 3 and 4, when the primary sears 27, 37 are disengaged by a user application of force 56 to the trigger 30, that force 57 will prevent the trigger 30 from moving toward the hammer 20 and will prevent the catch 64 from operating.

Referring to FIG. 2, in some embodiments, a reference plane 72 is defined that contains the hammer axis 22 and the trigger axis 32. In some embodiments, some fire control structure is located to a first side 71 of the reference plane 72 and some fire control structure is located to a second side 73 of the reference plane 72.

In some embodiments, the hammer 20 comprises a strike face 82 arranged to contact a firing pin. In some embodiments, the hammer 20 comprises a disconnector engagement surface 84. In some embodiments, the strike face 82 and the disconnector engagement surface 84 are located to the first side 71 of the reference plane 72.

In some embodiments, a sear engagement location 75 is defined where the hammer sear 27 contacts the trigger sear 37. In some embodiments, the sear engagement location 75 is located to the second side 73 of the reference plane 72.

In some embodiments, a catch engagement location 77 is defined where the catch 64 engages the stop 70. In some embodiments, the catch engagement location 77 is located to the second side 73 of the reference plane 72.

Referring to FIG. 3, in some embodiments, a trigger radial vector 80 is defined that intersects the trigger sear 37 and the stop 70.

In some embodiments, the fire control arrangement disclosed herein is compatible with two-stage triggers. For example, in some embodiments, the trigger sear 37 and hammer sear 27 disclosed herein can comprise the secondary sears of a two-stage trigger. Thus, in some embodiments, a two-stage trigger can comprise a drop-safe catch 64 and the sear geometry configurations described herein.

Figure 9:
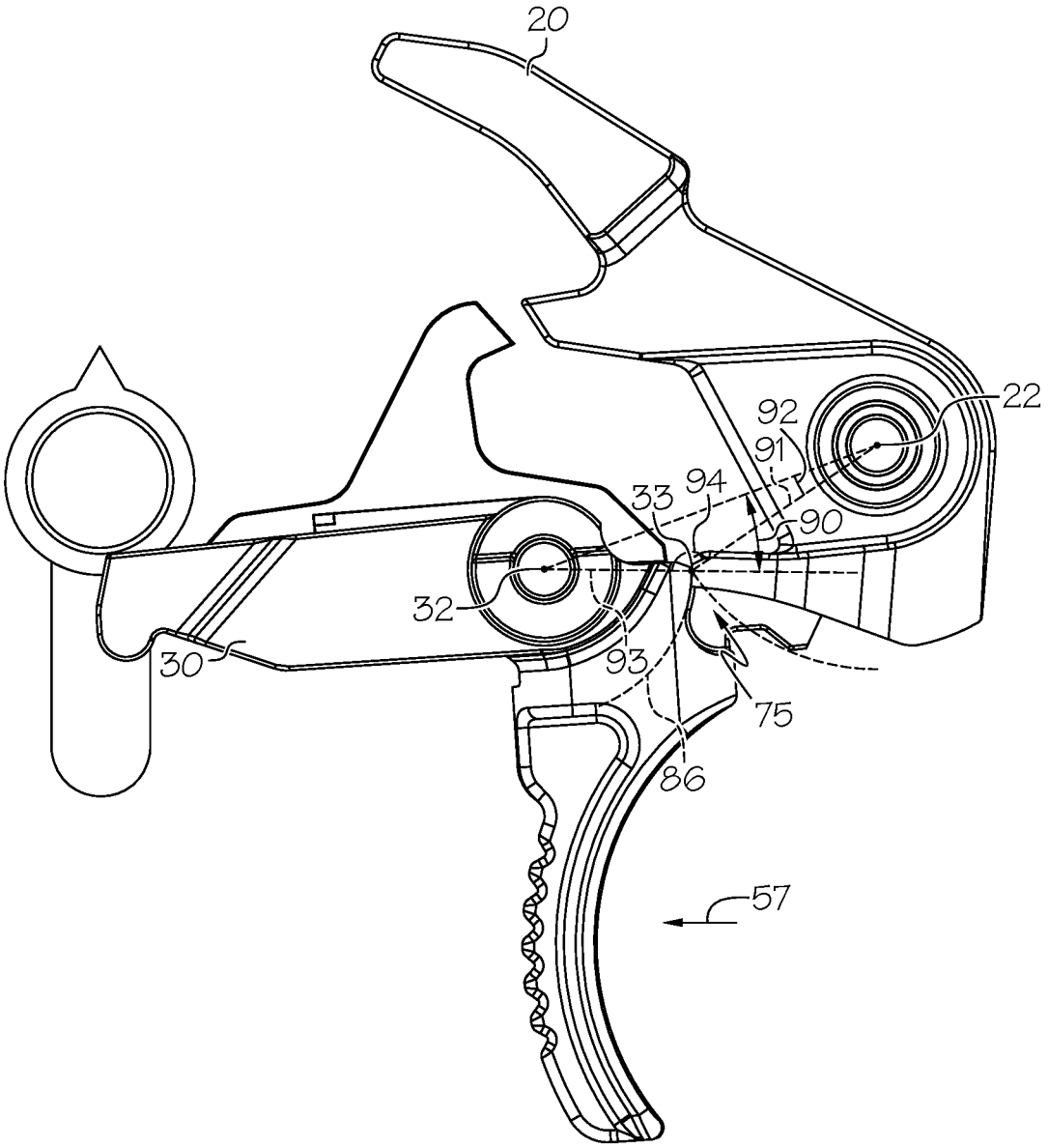
FIG. 9 shows another embodiment of a fire control assembly.

FIG. 9 shows another embodiment of a fire control assembly 10. In some embodiments, the trigger sear 37 comprises a planar surface. In some embodiments, the hammer sear 27 comprises a planar surface.

In some embodiments, the trigger sear 37 comprises a leading edge 33. In some embodiments, the leading edge 33 contacts and slides along the hammer sear 27 as the trigger 30 is pulled. In some embodiments, the leading edge 33 follows a travel path 86 that does not overlap with hammer structure. For example, in some embodiments, the leading edge 33 follows a travel path 86 that does not overlap with hammer structure located adjacent to the hammer sear 27. This arrangement allows the trigger 30 to be pulled and the leading edge 33 to travel along the hammer sear 27 without causing rotation of the hammer 20.

In some embodiments, the specific location of the sear engagement location 75 with respect to the hammer axis 22 and the trigger axis 32 provide geometry that allows the leading edge 33 to move in a way that does not overlap hammer structure.

In some embodiments, a reference triangle can be drawn with angles oriented at the hammer axis 22, the trigger axis 32 and the sear engagement location 75. The reference triangle defines a hammer interior angle 92 near the hammer axis 22, a trigger interior angle 90 near the trigger axis 32 and a sear engagement interior angle 94. In some embodiments, the sear engagement interior angle 94 is 120 degrees or more.

It has been found that combining a relatively large sear engagement interior angle 94 along with a trigger sear radius that is less than the hammer sear radius provides a better trigger feel during operation. Increasing the sear engagement interior angle 94 generally causes a reduction in the hammer interior angle 92 and/or the trigger interior angle 90. Shortening the trigger sear radius tends to improve the trigger feel. This is believed to be due to a reduction in the moment arm distance to the leading edge 33, which reduces torque feedback to the shooter caused by grit on the hammer sear 27 during trigger pull.

In some embodiments, the sear engagement interior angle 94 is 120 degrees or more. In some embodiments, the sear engagement interior angle 94 is 130 degrees or more. In some embodiments, the sear engagement interior angle 94 is 130 degrees or more.

In some embodiments, the trigger sear radius 93 is less than the hammer sear radius 91. In some embodiments, the hammer sear radius 91 is at least 1.1 times the trigger sear radius 93. In some embodiments, the hammer sear radius 91 is at least 1.3 times the trigger sear radius 93. In some embodiments, the hammer sear radius 91 is at least 1.5 times the trigger sear radius 93.

Figure 10:
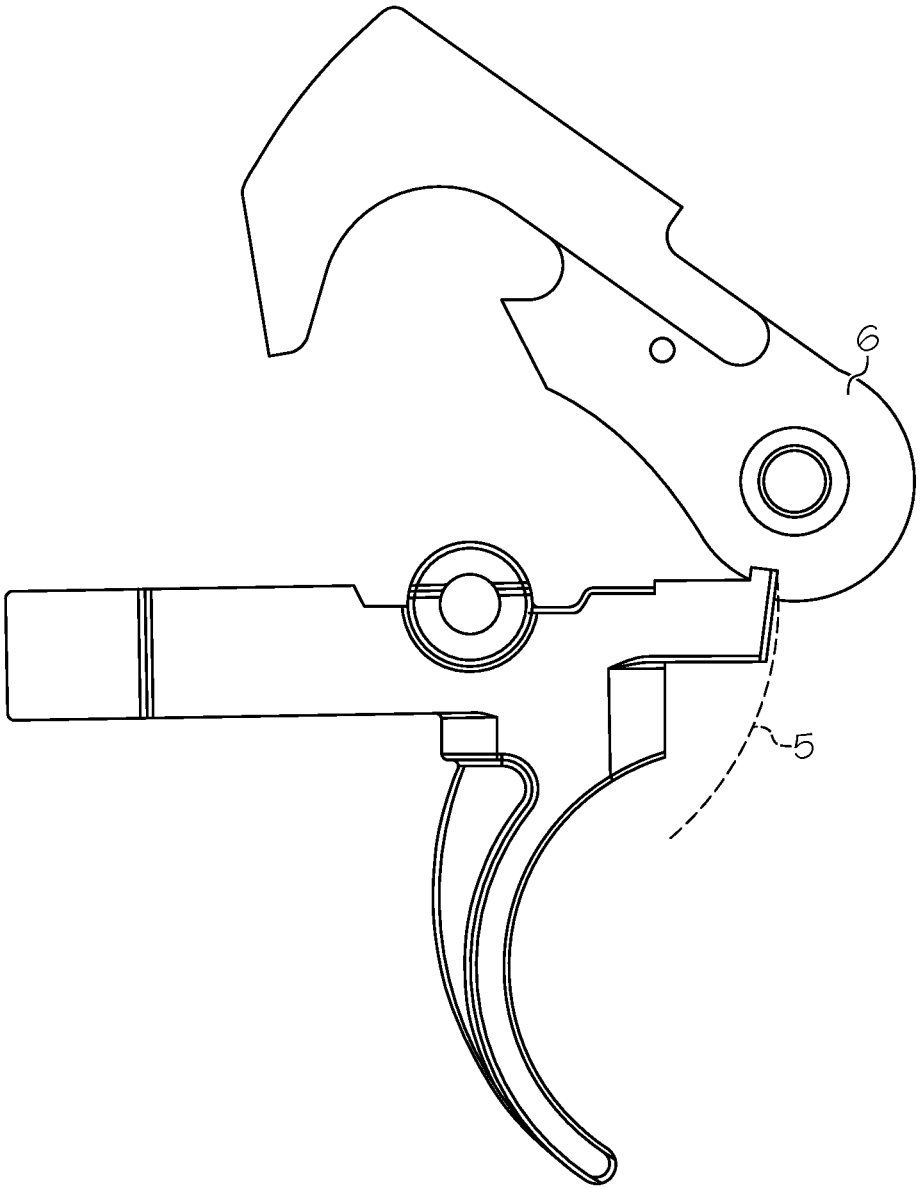
FIG. 10 (PRIOR ART)
FIG. 10 shows a prior art fire control assembly.

FIG. 10 shows a prior art mil-spec trigger. It can be noted that the travel path 5 of the leading edge of the trigger sear overlaps with structure of the hammer 6. This means that as the trigger is rotated and the leading edge travels along the hammer sear, the hammer must rotate about the hammer axis. This causes the hammer to move in an overcocking direction as the trigger is pulled. The arrangement in FIG. 10 increases trigger pull weight because force from the shooter's pull must provide the energy to rotate the hammer.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A fire control assembly comprising:

a trigger rotatable about a trigger axis, the trigger comprising a trigger sear and a stop;

a trigger spring arranged to bias the trigger in a first direction about the trigger axis;

a hammer rotatable about a hammer axis, the hammer comprising a hammer sear and a catch, the hammer comprising a first width portion and a second width portion, the first width portion comprising the hammer sear and excluding the catch, the second width portion comprising the catch and excluding the hammer sear;

a hammer spring arranged to bias the hammer in a second direction about the hammer axis; and a disconnector arranged to engage the hammer;

the fire control assembly comprising a first orientation wherein the trigger sear contacts the hammer sear and impedes rotation of the hammer, the fire control assembly comprising a second orientation wherein the stop contacts the catch and impedes rotation of the hammer;

wherein a sear engagement location and a catch engagement location are located to a common side of a reference plane that contains the hammer axis and the trigger axis.

2. The fire control assembly of claim 1, the catch comprising a cavity and the stop comprising a protrusion.

3. The fire control assembly of claim 1, in the first orientation, the hammer sear and the catch are located to a common side of a reference plane that intersects the hammer axis and the trigger axis.

4. The fire control assembly of claim 1, wherein the trigger sear and the stop are both oriented along a radial vector extending from the trigger axis.

5. The fire control assembly of claim 1, the trigger comprising a first width portion and a second width portion, the first width portion comprising the trigger sear, the second width portion comprising the stop.

6. The fire control assembly of claim 1, the hammer comprising a first rotational position in the first orientation and a second rotational position in the second orientation, the hammer comprising a third rotational position wherein the hammer is configured to strike a firing pin.

7. The fire control assembly of claim 6, wherein the second rotational position comprises an intermediate position located between the first rotational position and the third rotational position.

8. The fire control assembly of claim 1, the disconnector arranged to rotate about the trigger axis.

9. The fire control assembly of claim 1, the trigger sear contacting the hammer sear at the sear engagement location, a reference triangle extending between the trigger axis, the hammer axis and the sear engagement location comprising a sear location interior angle greater than 120 degrees.

10. A fire control assembly comprising:

a trigger rotatable about a trigger axis, the trigger comprising a trigger sear and a stop, the trigger comprising a first width portion and a second width portion, the first width portion comprising the trigger sear and excluding the stop, the second width portion comprising the stop and excluding the trigger sear;

a trigger spring arranged to bias the trigger in a first direction about the trigger axis;

a hammer rotatable about a hammer axis, the hammer comprising a hammer sear and a catch; and a hammer spring arranged to bias the hammer in a second direction about the hammer axis;

the fire control assembly comprising a first orientation wherein the trigger sear contacts the hammer sear and impedes rotation of the hammer, the fire control assembly comprising a second orientation wherein the stop contacts the catch and impedes rotation of the hammer;

the hammer comprising a first portion and a second portion, the first portion comprising a strike face and a disconnector engagement surface, the second portion comprising the hammer sear and the catch.

11. The fire control assembly of claim 10, the first portion located to a first side of a reference plane that intersects the hammer axis and the trigger axis.

12. The fire control assembly of claim 10, wherein a sear engagement location and a catch engagement location are located to a common side of a reference plane that intersects the hammer axis and the trigger axis.

13. A fire control assembly comprising:

a trigger rotatable about a trigger axis, the trigger comprising a trigger sear;

a trigger spring arranged to bias the trigger in a first direction about the trigger axis;

a hammer rotatable about a hammer axis, the hammer comprising a hammer sear;

a hammer spring arranged to bias the hammer in a second direction about the hammer axis;

the trigger sear contacting the hammer sear at a sear engagement location, a reference triangle extending between the trigger axis, the hammer axis and the sear engagement location comprising a sear location interior angle greater than 130 degrees;

wherein the fire control assembly is configured for use in an AR lower receiver.

14. The fire control assembly of claim 13, wherein a hammer sear radial distance is greater than a trigger sear radial distance.

15. The fire control assembly of claim 13, wherein a hammer sear radial distance is at least 1.5 times a trigger sear radial distance.

16. The fire control assembly of claim 13, wherein the hammer sear comprises an arc about the trigger axis.

* * * * *